US005156540A

United States Patent [19]

Fernau et al.

[11] Patent Number: 5,156,540

[45] Date of Patent: Oct. 20, 1992

[54] INTERNAL GEAR FUEL PUMP

[75] Inventors: Norbert Fernau, Nenterhausen; Helmut Kohlhaas, Wildeck, both of Fed. Rep. of Germany

[73] Assignee: VDO Adolf Schindling AG, Frankfurt am Main, Fed. Rep. of Germany

[21] Appl. No.: 698,678

[22] Filed: May 10, 1991

[30] Foreign Application Priority Data

Jul. 5, 1990 [DE] Fed. Rep. of Germany ..... 4021500

[51] Int. Cl.[5] ..... F04C 2/08; F04C 2/10

[52] U.S. Cl. ..... 418/152; 418/171; 418/179

[58] Field of Search ..... 418/152, 170, 171, 179

[56] References Cited

U.S. PATENT DOCUMENTS

| | | | |
|---|---|---|---|
| 3,152,551 | 10/1964 | Peters | 418/179 |
| 3,170,409 | 2/1965 | McLeod et al. | 418/179 |
| 4,384,828 | 5/1983 | Rembold et al. | 418/152 |
| 4,492,540 | 1/1985 | Yamamoto | 418/152 |
| 4,618,318 | 10/1986 | Hanson | 418/152 |

FOREIGN PATENT DOCUMENTS

| | | | |
|---|---|---|---|
| 180788 | 5/1986 | European Pat. Off. . | |
| 1231563 | 12/1966 | Fed. Rep. of Germany . | |
| 1426771 | 11/1968 | Fed. Rep. of Germany . | |
| 2312263 | 9/1974 | Fed. Rep. of Germany | 418/152 |
| 2422783 | 11/1975 | Fed. Rep. of Germany | 418/152 |
| 8908757 | 9/1989 | Fed. Rep. of Germany . | |
| 51-148084 | 9/1982 | Japan . | |
| 548064 | 9/1942 | United Kingdom . | |

*Primary Examiner*—Richard A. Bertsch
*Assistant Examiner*—David L. Cavanaugh
*Attorney, Agent, or Firm*—Martin A. Faber

[57] ABSTRACT

Feed unit, in particular for the feeding of fuel, having an electric drive motor and a pump unit coupled to it, which comprises a base plate, an intermediate plate having a recess for rotating pump parts and a cover, at least the base plate and the cover consisting of a ceramic material and the end sides of the base plate and of the cover which face the intermediate plate having ground surfaces.

20 Claims, 3 Drawing Sheets

INTERNAL GEAR FUEL PUMP

FIELD AND BACKGROUND OF THE INVENTION

The present invention relates to a feed unit, in particular for the feeding of fuel, having an electric drive motor and a pump unit coupled to it, the pump unit comprising a base plate provided with an inlet opening, an intermediate plate which rests against the base plate and has a recess in which rotating pump parts made of sintered metal, in particular a gerotor, are mounted for rotation, and a cover which rests on the intermediate plate and has an outlet opening as well as a passage opening for the shaft of the drive motor.

Feed units of this type are already known in which the base plate, the intermediate plate and the cover consist of a sintered steel. The rotating pump parts are arranged for rotation in the recess of the intermediate plate, and are constructed also of a sintered steel. They may be a plurality of rollers if the pump unit is developed as a roller vane pump or a pair of gear wheels which comprises an internally toothed and an externally toothed gear, a so-called internal geared wheel pump or else two externally toothed gears of an ordinary gear pump. In order to keep the wear between the rotating pump parts and the stationery pump parts slight, the base plate, the intermediate plate and the cover are subjected to an oxidizing vapor treatment whereby a hard oxide skin is formed on these parts, thus considerably reducing the wear between the different pump parts.

In order to obtain the highest possible efficiency of the pump, the smallest possible axial spaces are desired between the rotating pump parts and the cover or the base plate. Roughnesses of up to 5 μm can be obtained by suitable treatment of the sintered metal parts. However, due to the required vapor treatment, deformations on the order of magnitude of 8 to 10 μm are produced in the material treated in this manner. Since the oxide layer produced by the vapor treatment is only about 5 to 6 μm thick, even a reworking of the parts subjected to the vapor treatment results in only a slight improvement of the roughnesses.

Another disadvantage of these known pumps resides in the fact that their efficiency declines with age, due to the wear which occurs even with a pair of materials such as sintered steel and sintered steel oxide.

SUMMARY OF THE INVENTION

These difficulties and disadvantages are eliminated by the present invention.

It is, therefore, an object of the present invention to create a feed unit having a pump unit which has the highest possible efficiency which is reduced, if at all, only within narrow limits even over the entire life of the feed unit. In addition, the increase in the efficiency is to be obtained at the least possible expense.

According to the invention, at least the base plate (1) and the cover (3) consist of a ceramic material, and both the base plate (1) and the cover (3) have ground surfaces on their end side facing the intermediate plate (2), at least in the region of the rotating pump parts (10, 16).

By the use of ceramic material for the base plate and the cover, and by the development of the end side of each of said parts facing the intermediate plate with a ground surface, roughnesses of less than 1 μm can be obtained and thus, extremely small axial air spaces upon a suitable construction of the pump unit. Subsequent working of the base plate and of the cover is not required, so that the danger of deterioration of the ground surfaces by deformation is excluded. Since the ceramic material is considerably harder than the material of which the moveable pump parts are made, the wear of the pump unit is less than that of the known feed units and the pump unit of the invention thus has a comparatively long life.

The pair of materials and the development of the end sides of the base plate and of the cover in accordance with the invention lead, in addition, to better hot-running properties of the pump. This is essentially due to the fact that, as already mentioned, the axial spaces can be made extremely small and thus vapor bubbles present in the hot fuel cannot become stuck there but can be transported out of the pump chamber by the moveable pump parts.

The desired smooth surface of the relevant end sides of the base plate and the cover can be obtained by the grinding, lapping or honing of these end sides.

Therefore, when mention of ground surfaces is made below, there are to be understood, within the meaning of the present invention also honed or lapped surfaces or surfaces with a roughness of less than 1 μm.

As ceramic material, there will preferably be used oxide ceramics, in particular metal-oxide ceramics, although other ceramics such as silica ceramics and the like can also be used as long as they have the mechanical strength required for this use and can be provided with a ground surface having a roughness of less than 1 μm.

Since ceramic material which is suitable for the present purpose is substantially cheaper than the machined sintered steel used in the known pump units, the pump unit of the invention can, for this reason alone, be manufactured at less expense than the known pumps. This expense can, furthermore, be reduced by the fact that the intermediate plate is also made of ceramic material. However, this has the disadvantage that the radial dimensions of the pump unit must be selected larger than in the case of an intermediate plate of sintered material, since otherwise the mechanical properties of the pump unit are impaired.

The use of an intermediate plate (2) of ceramic material results, on the other hand, in the advantage that the hot-running properties of the pump unit are further improved, due to the fact that the ceramic has a smaller co-efficient of linear thermal expansion than sintered steel. Thus, ceramics customarily have a co-efficient of thermal expansion of between 6 and $8\times10^{-6}$ 1/°C., while sintered steel has one of about $12\times10^{-6}$ 1/°C. As the pump unit heats up, therefore, the sintered steel expands more strongly than the ceramic intermediate plate, so that with an increase in temperature of the pump unit, the axial spaces between the moving pump parts and the base plate or the cover become smaller and smaller.

According to features of the invention, this effect can, furthermore, be utilized to an increased extent by using an intermediate plate (2) of hard carbon o artificial carbon the coefficient of linear thermal expansion of which is between 4 to $6\times10^{-6}$ 1/°C. Artificial carbons are essentially a mixture of plastic or synthetic resin and graphite which is sintered together; hard carbon is essentially compressed, fired graphite.

BRIEF DESCRIPTION OF THE DRAWINGS

With the above and other objects and advantages in view, the present invention will become more clearly understood in connection with the detailed description of the preferred embodiment, when considered with the accompanying drawings, of which.

DETAILED DESCRIPTION OF THE PREFERRED EMBODIMENTS

Figure 1:
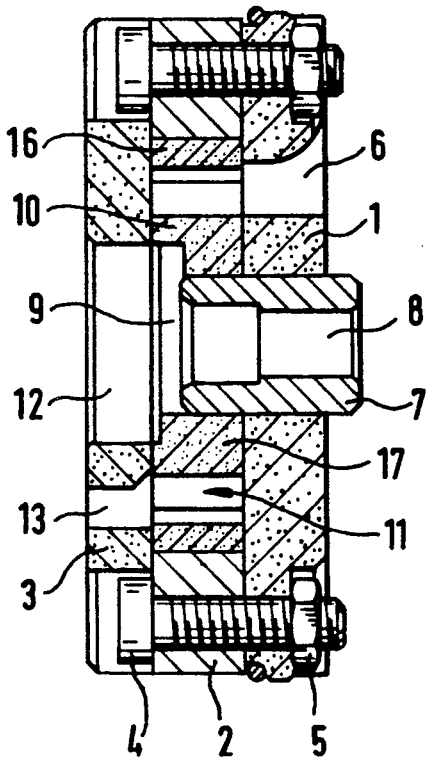
FIG. 1 is a section through a pump unit.

As appears, in particular, from FIG. 1, the pump unit consists of a base plate 1, an intermediate plate 2, and a cover 3, which are held together by four bolts 4 and the corresponding nuts 5.

The base plate 1 is provided with a crescent-shaped inlet opening 6 for the fluid to be fed, i.e. the fuel to be fed and with a guide bushing 7 the inner bore 8 of which serves to receive the drive shaft of the electric drive motor (FIG. 4) and the inwardly protruding projection 9 of which is developed for mounting the external gear wheel 10 of the gerotor 11.

The cover 3 is provided with a passage opening 12 for the drive shaft and with an outlet opening 13 for the fluid to be fed.

Both the cover 3 and the base plate 1 consist of aluminum oxide ceramics. The end sides of the base plate 1 and of the cover 3 which face the intermediate plate 2 are polished.

Figure 3:
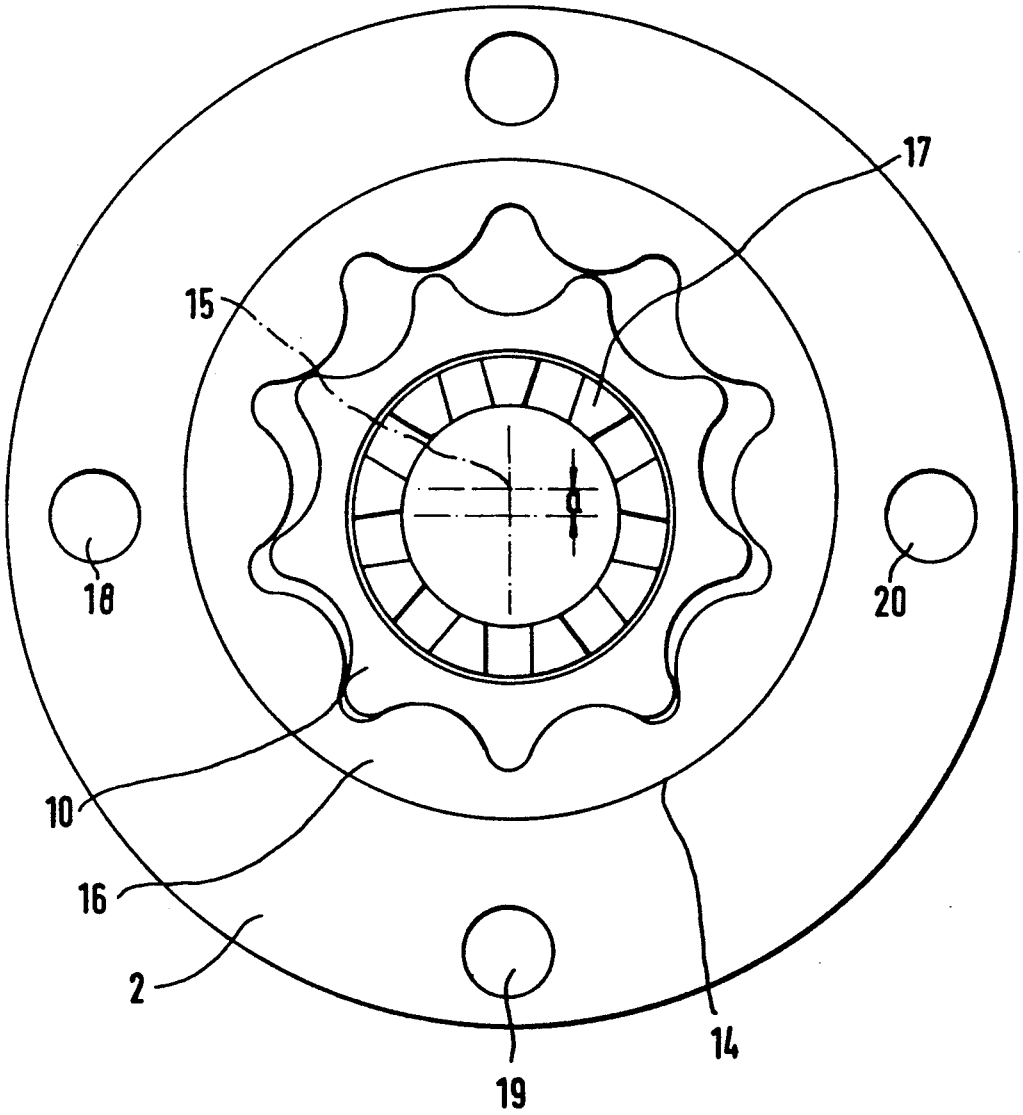
FIG. 3 is a top view of the intermediate plate with a gerotor of the pump unit of FIG. 1.

As can be noted, in particular, from FIG. 3, the intermediate plate 2 has a circular recess 14 which is eccentric by an amount 'a' to the central axis 15 of the pump unit. The gerotor 11 is mounted in the recess 14 and consists of an internal gear 16 and the centrally mounted external gear 10. Internal gear 16 and external gear 10 differ by one tooth. Both gears 10 and 16 are made of sintered metal, for instance Sint D 30.

On its end side facing the cover 3, the external gear 10 is provided with axial teeth 17 which are arranged in corresponding recesses of a mating piece which is seated on the drive shaft of the driver motor. The two interengaging parts, therefore, form a tooth-like coupling.

As already mentioned, the intermediate plate 2 can also be made of sintered metal. In this case, at least the inner surface of the circular recess is vapor-treated so that a hard sintered metal oxide is formed there, which reduces the wear between the internal gear 16 and the intermediate plate 2.

Such a vapor treatment can be dispensed with if the intermediate plate 2 is made of ceramics or of hard carbon or artificial carbon. In such cases, however, the intermediate plate 2 should be enlarged radially for reasons of strength; otherwise there is the danger of a breaking out of the bore holes 18, 19 or 20.

Figure 2:
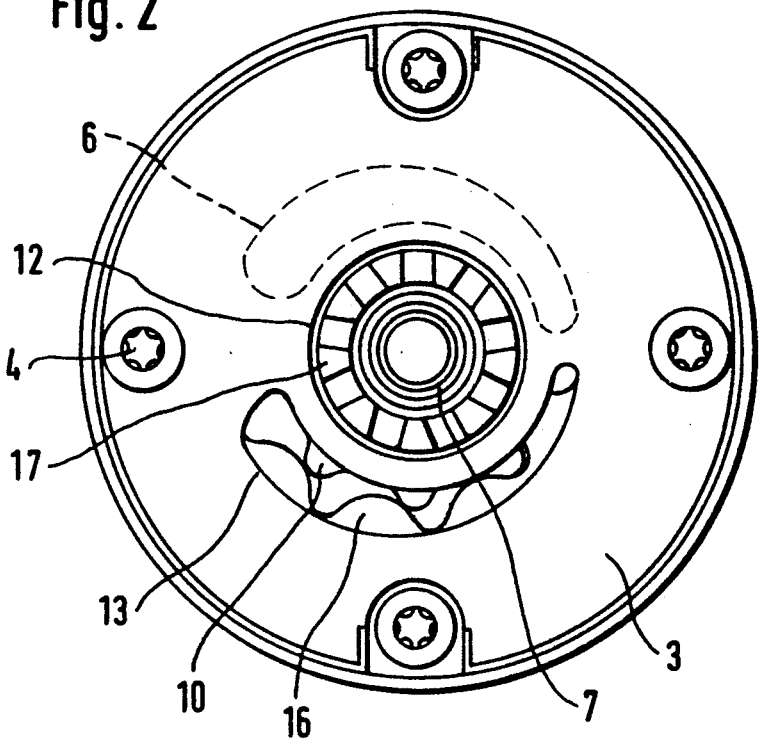
FIG. 2 is a top view of the pump unit of FIG. 1.
Figure 4:
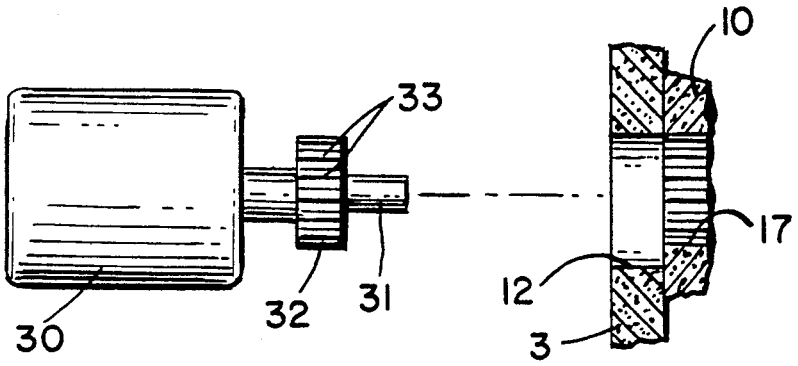
FIG. 4 shows diagrammatically connection of a motor with a gear of the pump unit.

FIG. 4 shows a simplified diagrammatic view of an electric motor 30 with drive shaft 31 positioned for entry into the passage opening 12 of the cover 3. The shaft 31 carries a toothed coupling 32 having recesses 33 for receiving the teeth 17 (FIGS. 1 and 2) of the external gear 10.

We claim:

1. A feed unit including a pump unit suitable for feeding a liquid including fuel and being operative with a drive motor coupled to the pump unit, the pump unit comprising a base plate provided with an inlet opening;

rotating pump parts and an intermediate plate which rests against the base plate, the intermediate plate having a recess for receiving the rotating pump parts, the rotating pump parts being made of sintered metal; and a cover which rests on the intermediate plate and has an outlet opening for liquid as well as a passage opening for a shaft of the drive motor; and wherein at least the base plate and the cover are made of a ceramic material, and both the base plate and the cover have ground surfaces on their respective end sides, facing the intermediate plate, at least in a region of the rotating pump parts;

the rotating pump parts include an external gear and an internal gear of larger diameter than the external gear and having a larger number of teeth than the external gear, a portion of the external gear meshing with the internal gear; and the intermediate plate comprises a material having a smaller coefficient of thermal expansion than the sintered metal of the rotating pump parts to reduce space between the intermediate plate and the rotating pump parts during an increase in temperature of the pump unit.

2. A feed unit according to claim 1, wherein the ceramic material is an oxide ceramic.

3. A feed unit according to claim 2, wherein the oxide ceramic is a metal-oxide ceramic.

4. A feed unit according to claim 1, wherein said intermediate plate is made of ceramic material.

5. A feed unit according to claim 1, wherein said intermediate plate is made of hard carbon.

6. A feed unit according to claim 2, wherein said intermediate plate is made of hard carbon.

7. A feed unit according to claim 3, wherein said intermediate plate is made of hard carbon.

8. A feed unit according to claim 1, wherein said intermediate plate is made of synthetic carbon.

9. A feed unit according to claim 2, wherein said intermediate plate is made of synthetic carbon.

10. A feed unit according to claim 3, wherein said intermediate plate is made of synthetic carbon.

11. Fuel pump comprising a base plate, a cover, an internal gear, and an intermediate plate, the intermediate plate being sandwiched between the base plate and the cover, the intermediate plate having a circle shaped recess for receiving and bearing the internal gear;

an external gear wheel enclosed by the internal gear and disposed eccentric to the internal gear, the external gear wheel being drivable in rotation and comprising a lesser number of teeth than the number of teeth of the internal gear, and wherein a portion of the teeth of the external gear wheel meshes with the teeth of the internal gear;

an inlet opening and an outlet opening disposed in the base plate and the cover respectively; and wherein the base plate and the cover are made of a ceramic material, and both the base plate and the cover have ground surfaces on their respective end sides facing the intermediate plate, the ground surfaces having a roughness of less than 1 micron at least in a region of the circle shaped recess;

the internal gear and the external gear wheel are made of a sintered metal; and the intermediate plate is made of a material having a smaller thermal expansion coefficient than the material of the internal gear and the external gear wheel.

12. A fuel pump according to claim 11, wherein the ceramic material is an oxide ceramic.

13. A fuel pump according to claim 12, wherein the oxide ceramic is a metal-oxide ceramic.

14. A fuel pump according to claim 11, wherein said intermediate plate is made of ceramic material.

15. A fuel pump according to claim 11, wherein said intermediate plate is made of hard carbon.

16. A fuel pump according to claim 12, wherein said intermediate plate is made of hard carbon.

17. A fuel pump according to claim 13, wherein said intermediate plate is made of hard carbon.

18. A fuel pump according to claim 11, wherein said intermediate plate is made of synthetic carbon.

19. A fuel pump according to claim 12, wherein said intermediate plate is made of synthetic carbon.

20. A fuel pump according to claim 13, wherein said intermediate plate is made of synthetic carbon.

* * * * *